US005346091A

United States Patent [19]

Hsu

[11] Patent Number: 5,346,091

[45] Date of Patent: Sep. 13, 1994

[54] MULTIPLE TRAY CONTAINER

[76] Inventor: Wen-Hsiung H. Hsu, No. 31, Alley 12, Lane 261, Sec. 2, Hsi-Yuan Rd., Taipei, Taiwan

[21] Appl. No.: 88,746

[22] Filed: Jul. 8, 1993

[51] Int. Cl.[5] ..... B65D 6/18

[52] U.S. Cl. ..... 220/503; 220/4.27; 220/6; 211/128; 206/503; 229/109; 229/120.32

[58] Field of Search ..... 220/503, 4.27, 4.26, 220/23.83, 23.86, 500, 507, 520, 6, 7, 4.29, 4.26, 678, 760, 666, 62, 527, 525, 524, 500, 507, 520

[56] References Cited

U.S. PATENT DOCUMENTS

| | | | |
|---|---|---|---|
| 1,135,117 | 4/1915 | Lafore | 229/198.1 |
| 1,655,793 | 1/1928 | McCrery | 220/62 |
| 2,003,326 | 6/1935 | Wellman | 229/109 |
| 2,021,559 | 11/1935 | Lengsfield | 229/109 |
| 2,292,499 | 8/1942 | Walsh | 220/527 |
| 2,305,629 | 12/1942 | Magnuson | 211/195 |
| 2,584,489 | 2/1952 | Morrison | 211/130 |
| 2,594,628 | 4/1952 | Evans | 206/503 |
| 2,663,608 | 12/1953 | Schauer | 220/4.27 |
| 2,740,534 | 4/1956 | Torrent | 211/195 |
| 2,758,774 | 8/1956 | Grunert et al. | 229/120.32 |
| 2,769,679 | 11/1956 | Wiseman | 220/62 |
| 3,790,018 | 2/1974 | Farkas | 220/4.26 |
| 4,173,284 | 11/1978 | March | 211/128 |
| 4,320,846 | 3/1982 | Meyering et al. | 206/390 |
| 4,742,951 | 5/1988 | Kelly et al. | 229/109 |
| 4,850,506 | 7/1989 | Heaps, Jr. et al. | 229/109 |
| 4,998,616 | 3/1991 | Hillinger | 220/520 |
| 5,156,289 | 10/1992 | Goof | 206/373 |

*Primary Examiner*—S. Castellano
*Attorney, Agent, or Firm*—Ladas & Parry

[57] ABSTRACT

A box includes an elongated surrounding wall and a plurality of trays. The surrounding wall has a plurality of interconnected vertical wall sections and two distal ends. Each of the vertical wall sections has an inner wall surface. Every two adjacent vertical wall sections are pivotally interconnected along a vertically extending fold line. The surrounding wall is movable between a folded position, wherein the vertical wall sections cooperatively confine an enclosure, and an unfolded position, wherein the distal ends are spaced apart from each other. Each of the trays has a periphery secured to the inner wall surface of a respective one of the vertical wall sections. The trays are superimposed and are disposed in the enclosure when the surrounding wall is in the folded position.

4 Claims, 4 Drawing Sheets

MULTIPLE TRAY CONTAINER

BACKGROUND OF THE INVENTION

1. Field Of The Invention

This invention relates to a box, more particularly to a box which facilitates the storage of articles therein and the retrieval of articles therefrom.

2. Description Of The Related Art

Presently, a conventional box is constructed to store articles of one kind therein. Therefore, a plurality of boxes are required for storing different kinds of articles. The boxes are usually stacked in order to reduce the required storage space, thereby inconveniencing the storage of articles therein and the retrieval of articles therefrom. Another kind of a conventional box is divided into many compartments in order to permit sorting of the different kinds of articles that are to be stored therein. However, the capacity of the compartments is limited. To increase the capacity of the compartments of the box, the size of the box should be increased.

SUMMARY OF THE INVENTION

Therefore, the main object of the present invention is to provide a box which facilitates the storage of articles therein and the retrieval of articles therefrom.

Another object of the present invention is to provide a box which can permit sorting of the different kinds of articles that are to be stored therein.

According to this invention, a box includes an elongated surrounding wall and a plurality of trays. The surrounding wall has a plurality of interconnected vertical wall sections and two distal ends. Each of the vertical wall sections has an inner wall surface. Every two adjacent vertical wall sections are pivotally interconnected along a vertically extending fold line. The surrounding wall is movable between a folded position, wherein the vertical wall sections cooperatively confine an enclosure, and an unfolded position, wherein the distal ends are spaced apart from each other. Each of the trays has a periphery secured to the inner wall surface of a respective one of the vertical wall sections. The trays are superimposed and are disposed in the enclosure when the surrounding wall is in the folded position.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Referring to FIGS. 1 to 5, a box according to a first embodiment of this invention includes an elongated surrounding wall 10 and a plurality of trays 20.

The surrounding wall 10 has a plurality of interconnected vertical wall sections and two distal ends. Each of the vertical wall sections has an inner wall surface 102. Every two adjacent vertical wall sections are pivotally interconnected along a vertically extending fold line 101. The surrounding wall 10 is movable between a folded position, wherein the vertical wall sections cooperatively confine an enclosure, and an unfolded position, wherein the distal ends of the surrounding wall 10 are spaced apart from each other. In the preferred embodiments of the present invention, the surrounding wall 10 has four vertical wall sections and each of the vertical wall sections is bent slightly inward at the intermediate portion along a vertical line which is parallel to the fold line 101 so that the vertical wall sections cooperatively confine an octagonal enclosure when the surrounding wall 10 is in the folded position. The configuration of the enclosure confined by the vertical wall sections may be rectangular, hexagonal, circular, etc, depending upon the number and configuration of the vertical wall sections.

The number of trays 20 conforms with the number of vertical wall sections of the surrounding wall 10. The configuration of the trays 20 conforms with the configuration of the enclosure confined by the surrounding wall 10 when the surrounding wall 10 is in the folded position. In the preferred embodiments of the present invention, the surrounding wall 10 has four vertical wall sections and four trays 20, which are octagonal in appearance, are provided thereon. Each of the trays 20 has a periphery secured to the inner wall surface 102 of a respective one of the vertical wall sections in such a manner that the trays 20 are superimposed and are disposed in the enclosure when the surrounding wall 10 is in the folded position.

Referring once more to FIGS. 1 to 5, when the box according to the first embodiment of the present invention is not in use, the surrounding wall 10 is maintained in the folded position. The surrounding wall 10 is moved to the unfolded position (FIGS. 3 and 4) so as to permit storage of articles (not shown) therein and to permit retrieval of articles. When the box is used as a display box, the box can be moved to a partly folded position so as to display the articles in the trays 20 appropriately.

Figure 1:
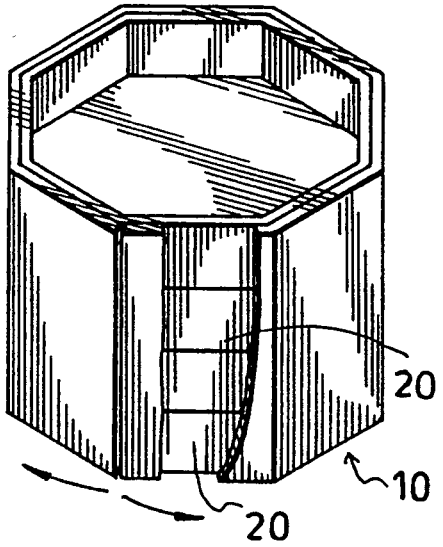
FIG. 1 is a cut away perspective view of a box according to a first embodiment of the present invention when the surrounding wall of the box is in the folded position.
Figure 2:
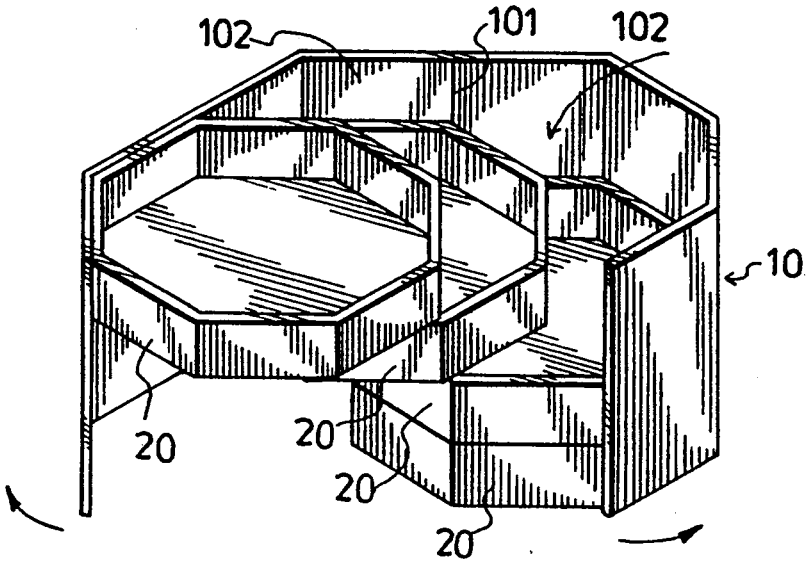
FIG. 2 is a perspective view illustrating the box according to the first embodiment of the present invention when the surrounding wall of the box is partly unfolded.
Figure 3:
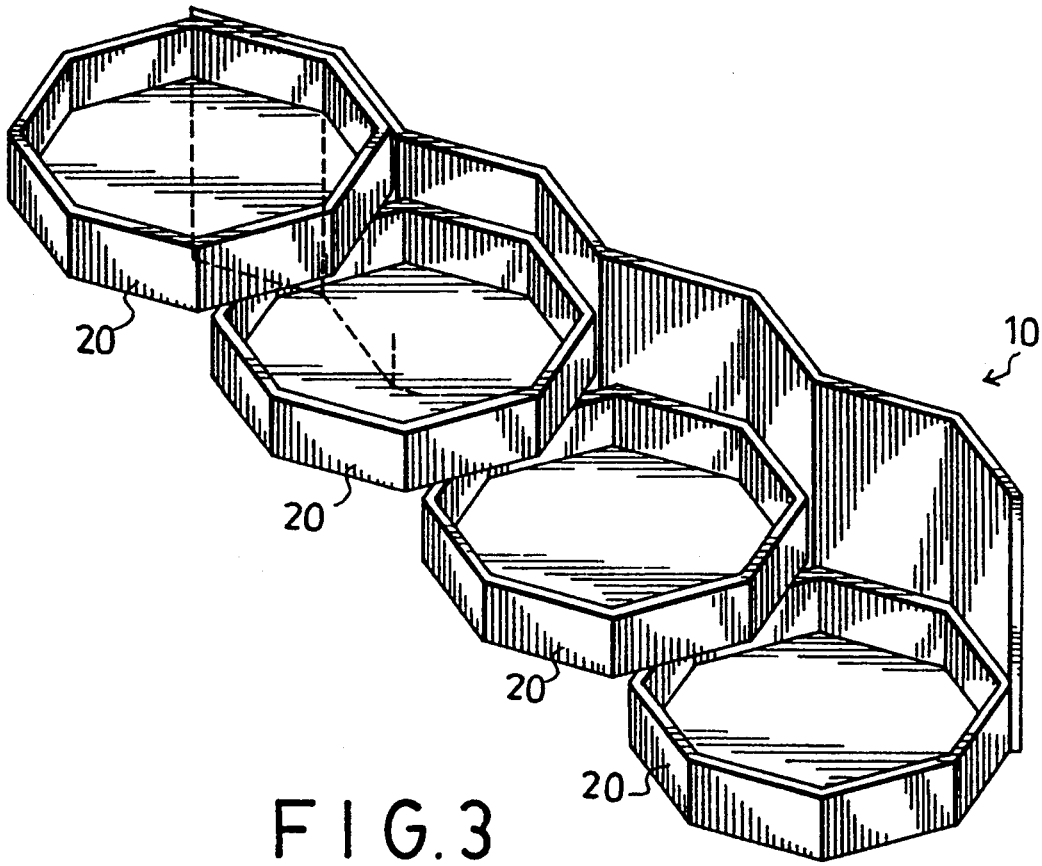
FIG. 3 is a perspective view showing the box according to the first embodiment of the present invention when the surrounding wall of the box is in the unfolded position.
Figure 4:
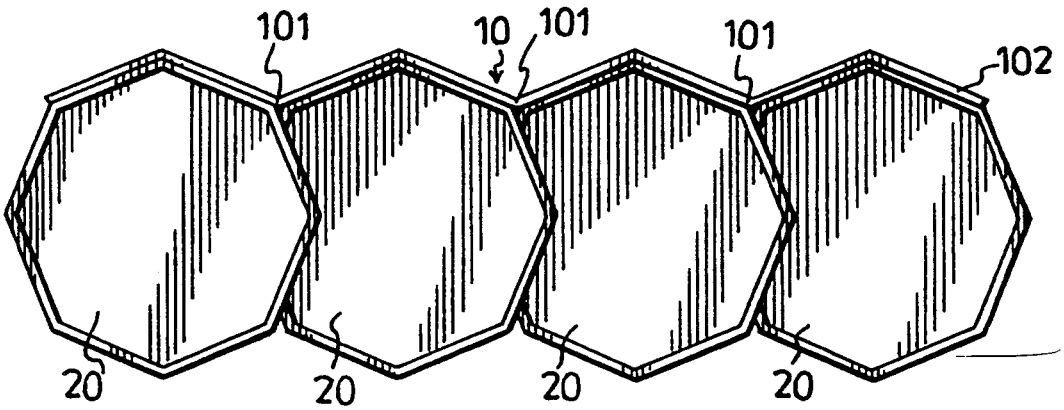
FIG. 4 is a top view of the box shown in FIG. 3.
Figure 5:
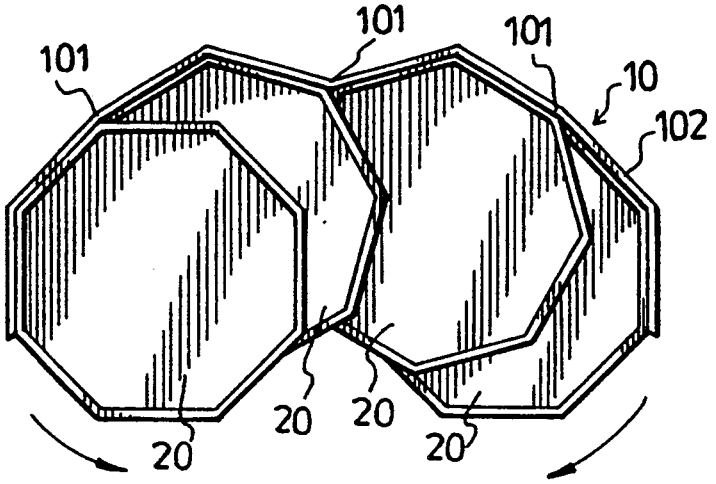
FIG. 5 is a top view of the box according to the first embodiment of the present invention illustrating how the surrounding wall of the box is folded.
Figure 6:
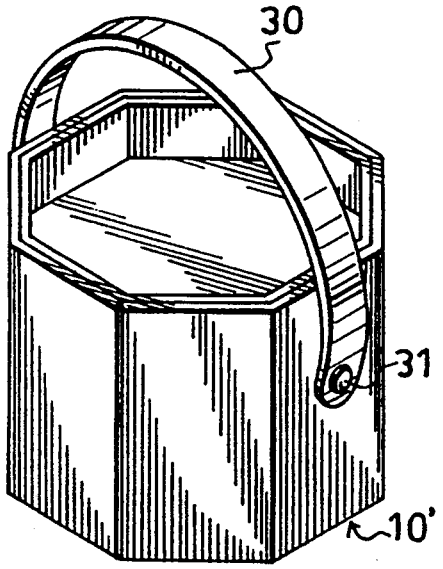
FIG. 6 is a perspective view showing a box according to a second embodiment of the present invention.

Referring to FIG. 6, a second embodiment of the present invention is shown. Unlike the first embodiment, the box further includes a strap 30 with a first end which is connected detachably to one of the vertical wall sections by means of a fastener 31, such as a bolt, and a second end which extends over the upper peripheries of the vertical wall sections and which is connected detachably to an opposite one of the vertical wall sections by means of a fastener (not shown) when the surrounding wall 10' is in the folded position, the box can thus be hand-carried.

Figure 7:
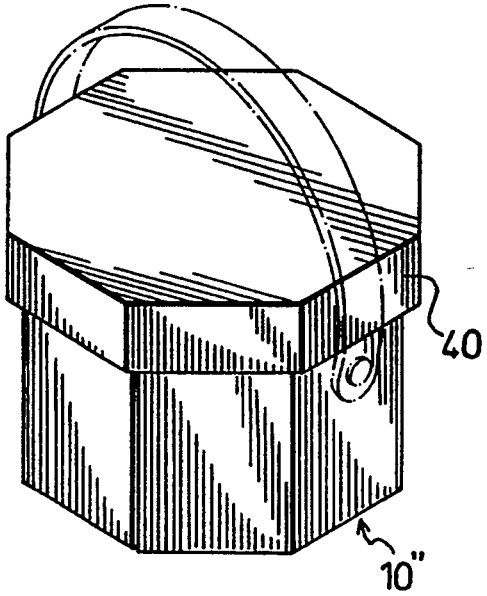
FIG. 7 is a perspective view of a box according to a third embodiment of the present invention.

A third embodiment of the present invention is shown in FIG. 7. The enclosure confined by the vertical wall sections of the surrounding wall 10'' has an open top. The box further includes a cover 40 which is mounted removably on the open top of the enclosure and which can prevent untimely unfolding of the surrounding wall 10''.

Figure 8:
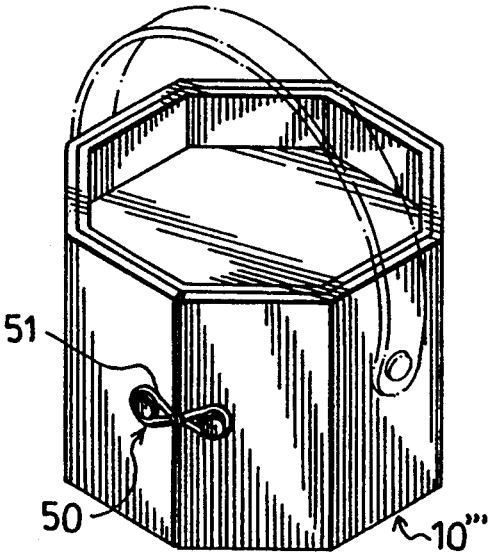
FIG. 8 is a perspective view of a box according to a fourth embodiment of the present invention.

Referring to FIG. 8, a fourth embodiment of the present invention is shown. In this embodiment, two outwardly projecting fastening pins 50 are provided respectively on the distal ends of the surrounding wall 10'''. A string 51 ties the fastening pins 50 together so as to prevent movement of the surrounding wall 10''' from the folded position to the unfolded position.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A box comprising:

an elongated surrounding wall having a plurality of interconnected vertical wall sections and two distal ends, each of said vertical wall sections having an inner wall surface, every two adjacent said vertical wall sections being pivotally interconnected along a vertically extending fold line, said surrounding wall being movable between a folded position, wherein said vertical wall sections cooperatively define an enclosure, and an unfolded position, wherein said distal ends are spaced apart from each other; and a plurality of trays, each having a periphery secured to said inner wall surface of a respective one of said vertical wall sections, so that the trays are arranged in a stack, the trays being disposed one substantially directly above another in said enclosure when said surrounding wall is in said folded position, and in staggered relationship to each other when the surrounding wall is in the unfolded position.

2. A box as claimed in claim 1, wherein each of said vertical wall sections has an upper periphery, said box further comprising a strap with a first end which is connected detachably to one of said vertical wall sections, and a second end which extends over said upper peripheries of said vertical wall sections and which is connected detachably to another one of said vertical wall sections that is opposite to said one of said vertical wall sections when said surrounding wall is in said folded position.

3. A box as claimed in claim 1, wherein said enclosure that is defined by said vertical wall sections has an open top, said box further comprising a cover which is mounted removably on said open top of said enclosure.

4. A box as claimed in claim 1, further comprising two outwardly projecting fastening pins which are provided respectively on said distal ends of said surrounding wall, and a string which ties said fastening pins together so as to prevent movement of said surrounding wall from said folded position to said unfolded position.

* * * * *

UNITED STATES PATENT AND TRADEMARK OFFICE

CERTIFICATE OF CORRECTION

PATENT NO. : 5,346,091

DATED : September 13, 1994

INVENTOR(S) : Wen-Hsiung Hsu

It is certified that error appears in the above-indentified patent and that said Letters Patent is hereby corrected as shown below:

On the title page, item [76], please delete the initial "H" in the inventor's name.

Signed and Sealed this

Seventh Day of March, 1995

Bruce Lehman

*Attest:*

BRUCE LEHMAN

*Attesting Officer*

*Commissioner of Patents and Trademarks*